United States Patent [19]

MacMichael et al.

[11] Patent Number: 4,759,635

[45] Date of Patent: Jul. 26, 1988

[54] MAGNETIC STIRRER APPARATUS WITH IMPROVED STIRRING ACTION

[75] Inventors: Gregory J. MacMichael, Morrisville, Pa.; Norman A. de Bruyne, Princeton, N.J.

[73] Assignee: Techne Corporation, Princeton, N.J.

[21] Appl. No.: 904,005

[22] Filed: Sep. 4, 1986

Related U.S. Application Data

[63] Continuation-in-part of Ser. No. 763,717, Aug. 8, 1985, abandoned.

[51] Int. Cl.[4] ..... B01F 13/08

[52] U.S. Cl. ..... 366/274; 366/247; 366/286

[58] Field of Search ..... 366/241–249, 366/250, 251, 255, 256, 273, 274, 279, 280, 285, 286; 422/224; 435/316

[56] References Cited

U.S. PATENT DOCUMENTS 4,465,377 8/1984 de Bruyne ..... 366/273

4,498,785 2/1985 de Bruyne ..... 366/274

4,512,666 4/1985 O'Connell ..... 366/273 X

*Primary Examiner*—Timothy F. Simone

*Attorney, Agent, or Firm*—Mason, Fenwick & Lawrence

[57] ABSTRACT

A stirrer apparatus for stirring culture medium has a flask with a lid, a floating magnetic stirrer responsive to a moving magnetic field, and a moving field generator including poles and coils. A guide system is provided for the stirrer including a rod which extend upwardly from the stirrer and a tube which extends through the lid, the rod extending into and being rotatable in the tube; the tube has a closed upper end. A stirrer apparatus having a floating magnetic stirrer with a central, downwardly extending, closed end guide tube, and lid with a guide rod extending into the guide tube. The stirrer included one or more continuous impellers extending across the rotational axis of the stirrer; in one embodiment, the impeller is provided by a bar magnet or magnets beneath a float and in another embodiment a bar magnet is within the float, and the impeller is a continuous blade.

33 Claims, 2 Drawing Sheets

FIG. 1
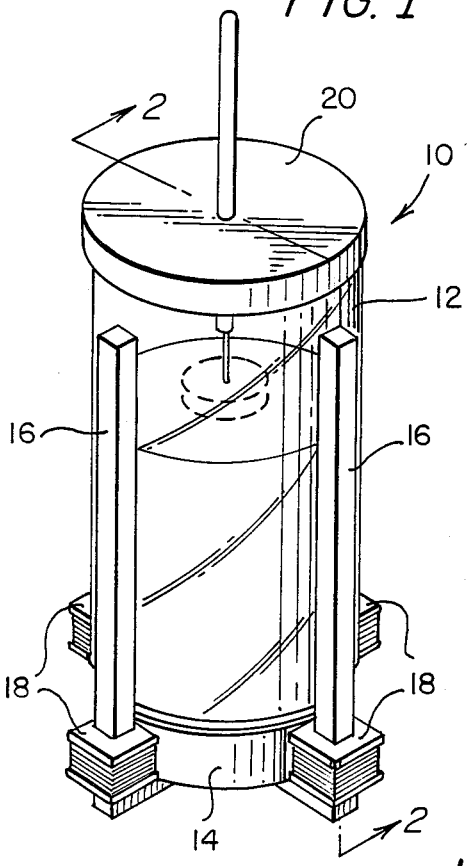
FIG. 2
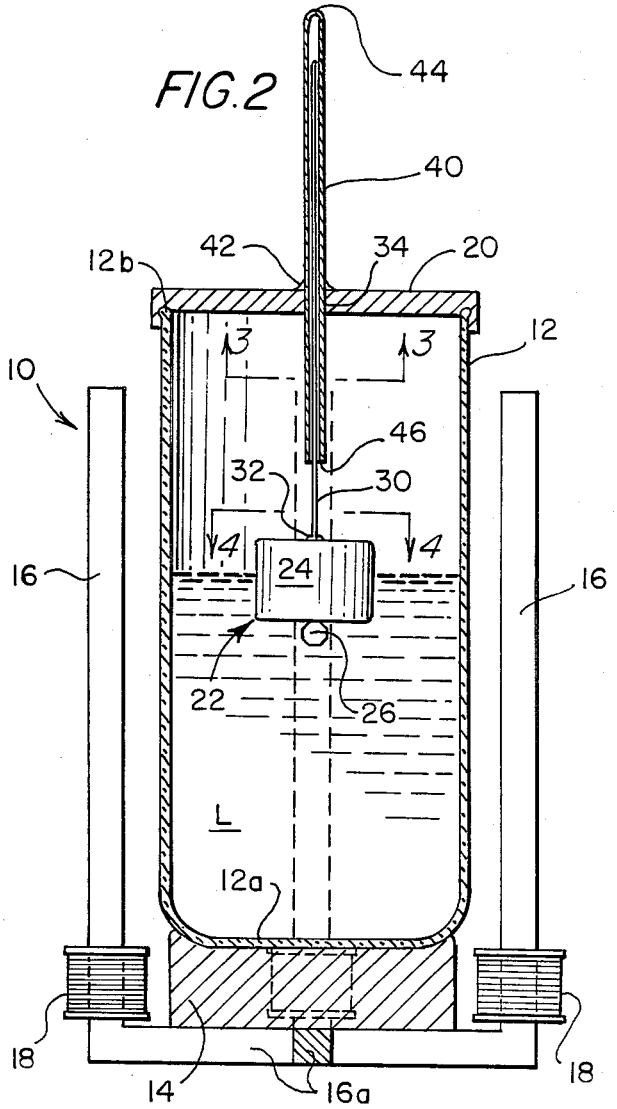
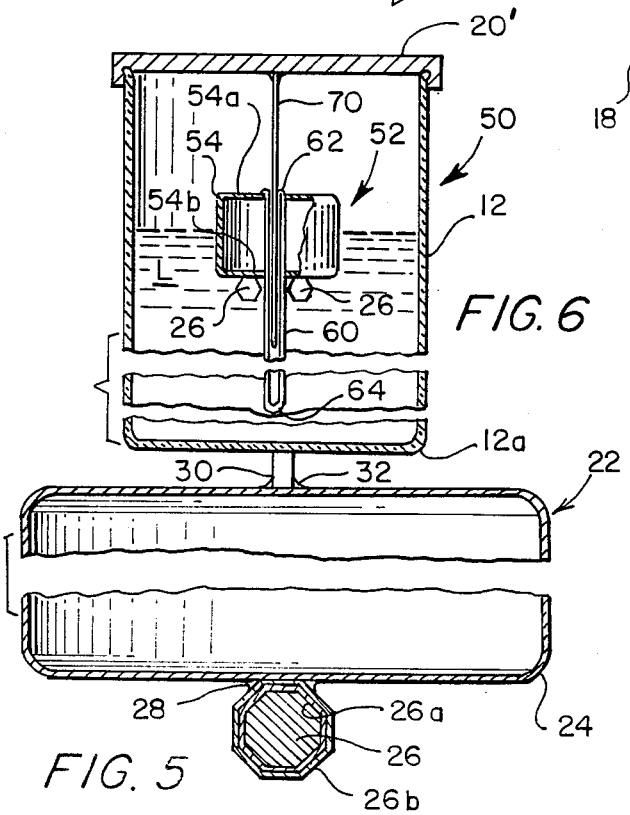
FIG. 6
FIG. 5
FIG. 3
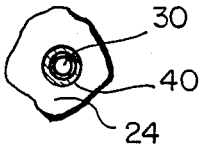
FIG. 4
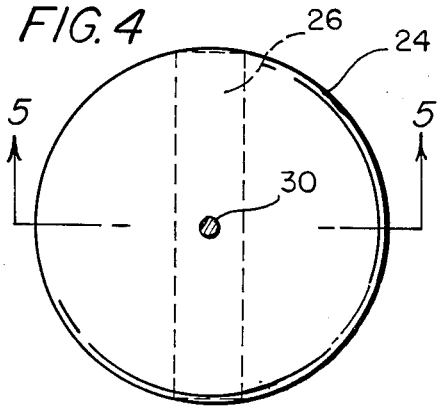

MAGNETIC STIRRER APPARATUS WITH IMPROVED STIRRING ACTION

CROSS REFERENCES TO RELATED APPLICATION

This application is a continuation-in-part of co-pending application Ser. No. 763,717 filed Aug. 8, 1985, by Gregory J. MacMichael, abandoned.

TECHNICAL FIELD

The present invention relates to a magnetically driven stirrer apparatus, wherein the stirrer is buoyant.

BACKGROUND ART de Bruyne U.S. Pat. No. 4,465,377 discloses apparatus for stirring liquid material, specifically culture medium. As therein noted, liquid culture medium provides for the growth of cells from nutrients which are contained in the medium. The stirring action which is to be imparted to such liquid culture medium is not a violent stirring, but is a gentle stirring, having as goals not only the stirring of the liquid culture medium and exposure of all cells to the gas above the liquid surface, but the avoidance of damage to the cells, such as would be occasioned by violent agitation, or by crushing of cells, as between two relatively moving parts. In that patent, there is disclosed a flask, with a buoyant, magnetically actuable stirrer within the flask, and an guide rod or shaft extending generally axially of the flask from top to bottom, the stirrer being movable along the guide rod or shaft as the liquid level is varied within the flask. The floating stirrer in some embodiments comprises a magnetic element, and on the exterior of the flask there is provided means for generating a rotating magnetic field to cause rotation of the magnetic element and the buoyant stirrer of which it forms a part. In some embodiments, a guide rod, supported in a lid of the flask, extends to the bottom of the flask, and passes through the buoyant stirrer. In another embodiment, a rotatable drive shaft is supported from the lid, and has a floating stirrer drivingly connected to it for rotation with it, the driving connection permitting movement of the stirrer along the drive shaft as the liquid level changes.

The above-noted patent makes reference to a number of preceding patents, which are incorporated herein by reference.

The structure disclosed in de Bruyne U.S. Pat. No. 4,465,377, while generally providing for satisfactory operation, has been found to be subject to improvement. For example, although the structure provided in the noted patent is constructed so that there is reduced danger of the crushing of cells as between relatively movable elements, the construction has not proven as free of risk as is desirable. In that construction, for example, the engagement between the structure of the floating stirrer and the guide rod or shaft was above the level of the liquid. While this construction minimized the risk of cell damage by liquid entering between the rod or shaft, on the one hand, and the floating stirrer on the other hand, the risk of crushing the cells was not completely eliminated.

A further improvement which is desirable is in connection with the flow of the liquid in the flask. The rotation of a buoyant stirrer effects approximately a "Thomson Secondary flow," causing liquid to be directed generally outwardly by the stirrer, the liquid then striking the walls of the flask and travelling downwardly towards the bottom and then spiralling upwardly along and about the axis of the flask to the stirrer, thereby providing for circulation and stirring of substantially all of the liquid culture medium in the flask. This is important since it is highly desireable that all of the cells, or as a high proportion of the cells as is possible, be exposed to the gaseous atmosphere which exists at the gas-liquid interface in the flask.

DISCLOSURE OF INVENTION

The present invention is directed to a magnetic stirrer apparatus which includes a flask, a floating magnetic stirrer, means for causing rotation of the stirrer, such as means for generating a moving magnetic field, and, further, provides for guiding of the buoyant stirrer so that it rotates about an axis extending through the flask, generally perpendicularly to the liquid surface, and is able to move along that axis with change in liquid level. The guiding is effected by a guide structure which includes, in a preferred embodiment, a guide rod extending only upwardly from the buoyant stirrer, and into a tube carried by the flask, particularly by a lid on the flask. The tube carried by the flask has its lower end positioned sufficiently above the highest level of the liquid in the flask so that there is no significant risk that liquid, including cells, will ever engage cooperating surfaces of the guide rod and guide tube. In this embodiment, there is no structure extending below the buoyant stirrer, and the stirrer extends without a gap across the axis of rotation. In an alternate embodiment, the buoyant stirrer is provided with a central depending tube, closed at its lower end, so that the tube has no liquid within it. The lower end of the tube is substantially above the bottom of the flask. A guide rod is fixed to the flask, preferably to the lid of the flask, and extends downwardly, entering the guide tube. Stirrers without gaps extend adjacent the depending tube.

Among the objects of the present invention are the provision of a magnetic stirrer apparatus having bearing surfaces of guide means located so that there is no substantial risk of cells becoming crushed between the bearing surfaces.

Another object of the present invention is the provision of such a stirrer apparatus which provides for enhanced, substantially idealistic liquid circulation.

Still another object of the present invention is to provide a stirrer apparatus with a buoyant magnetic stirrer which will provide for enhanced fluid flow, without disturbance of the natural circulation pattern of a floating rotating stirrer.

Other objects and many of the attendant advantages of the present invention will be readily understood from consideration of the following specification, claims, and drawings.

BRIEF DESCRIPTION OF THE DRAWINGS

FIG. 1 is a perspective view of a magnetic stirrer apparatus in accordance with the present invention.

FIG. 2 is a cross-sectional view taken on the line 2—2 of FIG. 1.

FIG. 3 is a cross-sectional view taken on the line 3—3 of FIG. 2.

FIG. 4 is a cross-sectional view taken on the line 4—4 of FIG. 2.

FIG. 5 is a cross sectional view, with parts broken away, taken on the line 5—5 of FIG. 4.

FIG. 6 is a cross-sectional view, with parts broken away, showing an alternate embodiment of the apparatus.

MODES FOR CARRYING OUT THE INVENTION

Figure 7:
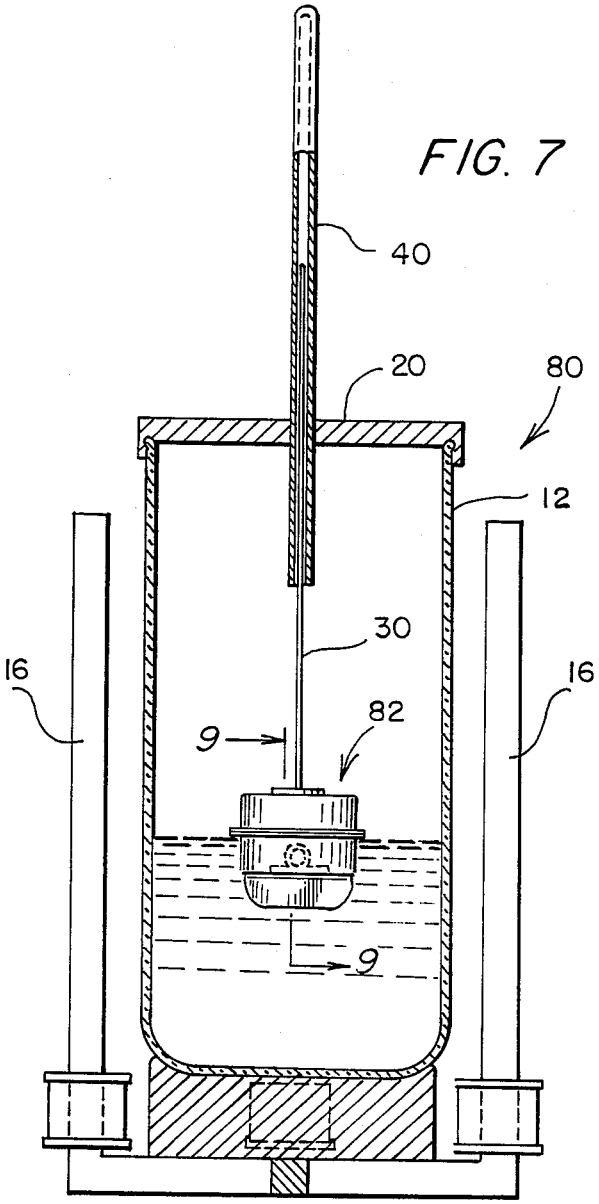
FIG. 7 is an elevational view, with parts in section, of another embodiment of a magnetic stirrer apparatus in accordance with the present invention.

Referring now to the drawings, wherein like or corresponding reference numerals are used for like or corresponding parts throughout the several views, there is shown in FIG. 1 a magnetic stirrer apparatus 10 including a flask 12 and a lid 20. A support base 14 is provided for the flask 12, and a plurality of poles 16 are provided, the poles being made of magnetizable material, and each having a coil 18 near the bottom thereof. The coils 18 are connected to electric circuitry in known manner to create a rotating magnetic field which extends into the flask 12. The poles 16 may have horizontal portions 16*a* which extend beneath the support base 14, as shown in FIG. 2.

Also shown in FIG. 2 is the flask 12, which is of generally cylindrical configuration, having a bottom 12*a*, and a peripherally extending lip 12*b*. On the lip 12*b*, there may be seen the lid 20.

A floating magnetic stirrer 22 is provided, which includes a generally cylindrical hollow member 24 to the bottom which is attached a magnetic bar 26.

A guide rod 30 extends upwardly from the upper surface of the member 24. As shown in FIG. 3, the member 24 is cylindrical, and the guide rod 30 is placed on and extends along the axis of cylindrical hollow member 24. As shown in FIG. 2, the guide rod 30 is attached to cylindrical hollow member 24 by means 32, which may be welding, when the cylindrical hollow member 24 and the guide rod 30 are of, for example, stainless steel.

Referring again to FIG. 4, it will be seen that the bar magnet 26 extends diametrically across the lower surface of the cylindrical hollow member 24.

The bar magnet 26 functions as a stirrer or impeller and is continuous from end to end thereof, having no gap at the axis of rotation.

The lid 20 has a central aperture 34 therein, and a gide tube 40 extends through the lid 20, being secured to it by the attachment means 42, which may be welding, solder, adhesive, etc., depending upon the materials of which lid 20 and guide tube 40 are made. Guide tube 40 is closed at its upper end 44, its lower end 46 being at a location which is above the upper surface of the cylindrical hollow member 24 and the attaching means 32 at the highest level to which the liquid L in flask 12 will be permitted to rise. As is well known, the flask is partially but not completely filled, and after stirring, a small part of the liquid culture medium may be withdrawn, and replaced by a substantially equal amount of liquid: hence, the liquid level varies somewhat, but within a limited range, such as approximately the middle third of flask 12.

As shown in FIG. 3, the guide rod 30 extends into the guide tube 40 with some small clearance. This permits the guide rod 30 to move axially within guide tube 40, and also permits the guide rod 30 to move axially within the guide tube 40. Guide tube 40 may be of stainless steel, plastic, etc., and if it is of plastic, may be either clear or opaque.

As shown in FIG. 5, the magnetic bar 26 is of known construction, being magnetized steel of octagonal cross-sectional shape. It is provided with a Telfon® sheath 26*a* which is coated with silicone layer 26*b*, the latter being adhered by adhesive 28 to the bottom surface of the cylindrical hollow member 24.

In operation, the floating stirrer 22 and liquid L are provided in the flask 12, after which the lid 20 is positioned above the upper end of guide rod 20 and lowered so that the guide rod 30 extends into the guide tube 40, lid 20 engaging the lip 12*b* of flask 12. The rotating field generating means including poles 16 and coils 18 is energized, to produce a rotating magnetic filed which causes the magnet 26 to rotate. Magnet 26, which functions as an impeller and which is the lowest part of the buoyant stirrer 22, causes stirring of the liquid L within the flask 12 in the manner above discussed, that is, by impelling the liquid outwardly to the walls of flask 12 and then downwardly to the bottom 12*a* and then upwardly, generally along and about the axis of flask 12. As is apparent, the portion of guide rod 30 and guide tube 40 which are axially coextensive are remote from the upper surface of the liquid L so that there is no significant risk of liquid culture medium L entering between such surfaces, thereby avoiding any possibility of crushing of cells in the liquid L. Additionally, since there is no structure below the magnetic-impeller 26, and since it is continuous and with a gap, there is no obstruction to axial upward flow, so that the flow of the liquid, which defines the interface between the liquid L and the gaseous medium above it and are there exposed to the gaseous medium.

In FIG. 6 there is shown a portion of an alternate embodiment of a stirrer apparatus 50, the flask 12 being shown broken away, and the poles 16 and coils 18 being omitted for clarity. In the apparatus 50, a buoyant stirrer 52 is provided, comprising a cylindrical hollow member 54 having a guide tube 60 extending there through, preferably along the axis thereof. The upper end 62 of guide tube 60 is at the upper surface of the cylindrical hollow member 54, guide tube 60 having a closed lower end 64, and being in sealing engagement with the upper wall 54*a* and the lower wall 54*b* of the cylindrical hollow member 54. The cylindrical hollow member 24 is thereby hermetically sealed, providing a float, and the guide tube 60 is not subject to having any of the liquid L enter into it. To the bottom of the hollow cylindrical member 54 there are secured a pair of substantially parallel, spaced bar magnets 26, which serve as both magnetic field driven member and as impellers. Bar magnets 26 are each continuous, and are closely adjacent the guide tube 60.

The lower end 64 of guide tube 60 is substantially above the bottom 12*a* of flask 12, so that, as in the first embodiment, there is unobstructed flow of liquid in the region along and about the axis of the flask which extends upwardly from the bottom 12*a*. This unobstructed region changes length with changes in liquid level, but is of substantial extent even at the lowest level of liquid L, so that the circulatory flow is at or close to idea, providing exposure of substantially all cells to the gaseous medium.

A lid 20' is provided, having a guide rod 70 extending downwardly from the central part thereof, and into the guide tube 60.

In operation, the stirring apparatus 50 functions similarly to the stirrer apparatus 10. The buoyant stirrer 52 is caused to rotate the magnet-impellers 26 causing the above-noted outward flow of fluid to the walls of the flask 12 from closely adjacent the axis of rotation. Because of the provision of the region of unobstructed flow above the bottom 12*a* on the flask axis and the impellers without gaps, the circulatory stirring motion will be at most minimally disrupted from the ideal or close to ideal pattern achieved by the apparatus 10. Apparatus 50 even with depending tube 60 nevertheless provides for substantial circulation so that substantially all of the cells in the liquid L are exposed to the gaseous medium above the surface thereof. Guidance of the buoyant stirrer 52 is provided by the guide rod 70 entering into the guide tube 60.

Referring to FIG. 7, there is shown a magnetic stirrer apparatus 80, which is generally similar to the apparatus 10 shown in FIG. 1, differing therefrom in the construction of the floating magnetic stirrer 82 which is within a flask 12, having a lid 20 thereon, which supports guide tube 40, which latter receive the guide rod 30 attached to the magnetic stirrer 82.

Figure 8:
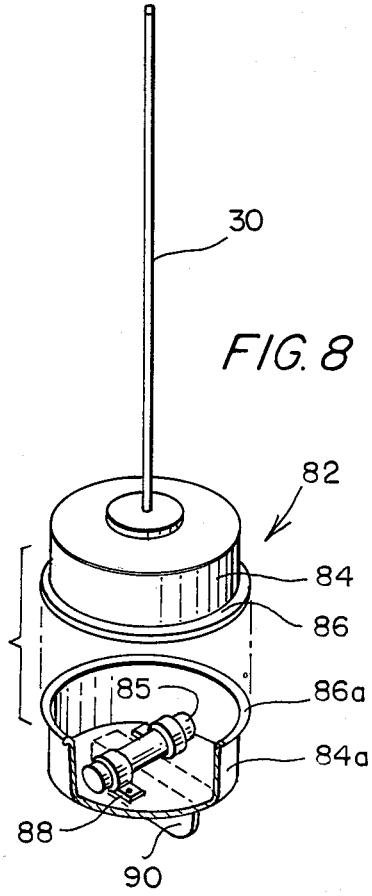
FIG. 8 is a perspective, exploded view of parts of the apparatus shown in FIG. 7.
Figure 10:
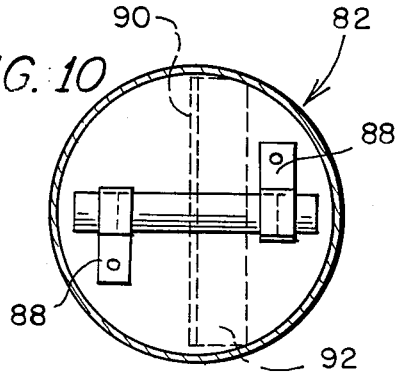
FIG. 10 is cross-sectional view taken on the line 10—10 of FIG. 9.
Figure 9:
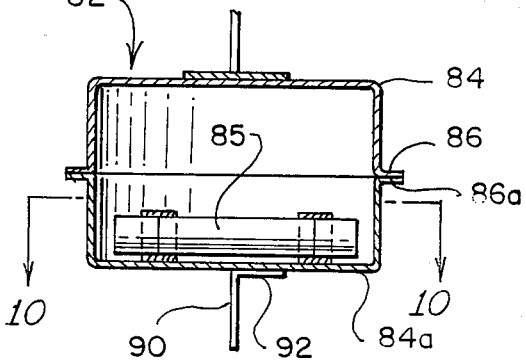
FIG. 9 is a cross-sectional view taken on the line 9—9 of FIG. 7.

Referring to FIG. 8., the magnetic stirrer 82 will be seen to comprise an upper cup-shaped member 84 having a flange 86, and a lower cup-shaped member 84*a* having a flange 86*a*. A bar magnet 85 is secured to the lower cup-shaped member 84*a* by straps 88 which attached to the inner surface of the bottom wall of cup-shaped member 84*a*. As shown in FIG. 9, the flanges 86 and 86*a* are in abutting relationship, and are secured together, to provide to hollow member which, together with magnet 85 therewithin, is buoyant. Attached to the undersurface of the buoyant member formed by the cup-shaped members 84 and 84*a* is an impeller 90, which is formed as a single continuous blade extending through and outwardly of the axis of rotation of the floating magnetic stirrer 82 when rotated by the magnetic field of poles 16, and when guided by the guide rod 30 and guide tube 40. The impeller 90 may have a shape selected to provide optimum fluid movement. As shown in FIGS. 9 and 10, the impeller 90 includes a horizontal flange 92 which is secured to the bottom surface of the cup-shaped member 84*a*.

In operation, the stirrer apparatus 80 functions similarly to the stirrer apparatus 10. The Thomson flow is effected by the continuous, uninterrupted impeller 90 attached to and forming a part of the floating magnetic stirrer 82. The magnet 85 is housed within the hollow member provided by the opposed cup-shaped member 84 and 84*a*.

There has been provided an improved stirring apparatus, wherein, in a first embodiment, all of the guide structure is in the gaseous atmosphere above the liquid and the flask, and is above the floating magnetic stirrer; the impeller provided by a bar magnet is continuous, being without a gap at the axis of rotation. There is thereby achieved ideal or close to ideal fluid stirring and circulation and no practical risk of crushing of cells of a liquid culture medium.

In a second embodiment, a guide structure is provided which extends less than the full distance between the floating magnetic stirrer and the bottom of the flask, leaving an unobstructed fluid flow region along the axis above the bottom of the flask, with a pair of continuous impellers, so that improved stirring and liquid circulation is achieved in comparison to prior art devices, and there being only a low risk of cell damage, as by crushing between surfaces of the guide elements.

In a third embodiment, the floating stirrer comprises a hollow member with a magnet within it, and having a continuous blade depending from the bottom of the member.

It will be obvious to those skilled in the art that various changes may be made without departing from the spirit of the invention, and therefore the invention is not limited to what is shown in the drawings and described in the specification but only as indicated in the appended claims.

I claim:

1. Apparatus for stirring liquid such as a culture medium comprising:
   - a flask;
   - stirrer means for stirring liquid medium in said flask comprising a magnetically attractable stirrer buoyant in said liquid;
   - means for rotating said stirrer means by applying an electromagnetic force to said magnetically attractable stirrer;
   - means for guiding said stirrer means for rotation about a vertical axis as said stirrer is rotated by said rotating means and for axial movement with change in the level of liquid in said flask; and
   - means for permitting an unobstructed flow of liquid in a region along the axis of the flask extending upwardly from the bottom thereof to said stirrer means.

2. The stirring apparatus of claim 1, said guiding means comprising a guide rod and a guide tube, and means for connecting one of said guide elements to said buoyant stirrer and the other of said guide elements to said flask.

3. The stirring apparatus of claim 1, said guiding means comprising the lowest part of said buoyant stirrer means, said guiding means being spaced from the bottom of said flask.

4. The stirring apparatus of claim 1, said buoyant stirrer means comprising a continuous impeller extending outwardly from the axis of rotation of said stirrer means.

5. The stirring apparatus of claim 2, said connecting means connecting said guide rod to said buoyant stirrer means.

6. The stirring apparatus of claim 2, said connecting means connecting said guide tube to said buoyant stirrer means, the lowest part of said stirrer means comprising the lower end of said guide tube.

7. Apparatus for stirring liquid such as a culture medium comprising:
   - a flask;
   - buoyant, magnetically attractable stirrer means for stirring liquid medium in said flask;
   - means for rotating said stirrer means; and
   - means for guiding said stirrer means
     - (a) for vertical movement in said flask as the level of liquid therein changes, and
     - (b) for restricting lateral movement of said stirrer means,
   - said guiding means comprising relatively movable elements connected to said buoyant stirrer means and said flask, respectively, said guiding means preventing entry of liquid of said flask between said elements, whereby to prevent crushing of cells within said liquid.

8. The stirring apparatus of claim 7, one said guide element attached to and extending upwardly from said stirrer means.

9. The stirring apparatus of claim 8, and means carried by said flask for supporting said other guide element.

10. The stirring apparatus of claim 9, said flask comprising a vessel having a lip defining an opening, said guide element supporting means engaging said lip.

11. The stirring apparatus of claim 8, said flask having a lid, the other said guide element carried by said lid.

12. The stirring apparatus of claim 8, said first guide element comprising a rod and said second guide element comprising tubular means for slidably receiving said rod therein, and means for supporting said tubular means on said flask.

13. The stirring apparatus of claim 12, said tubular means rotatably receiving said rod therein.

14. The stirring apparatus of claim 8, said first guide element comprising a rod, said second guide element comprising tubular means for rotatably and slidably receiving at least a part of said rod therein, and means for supporting said tubular means on said flask.

15. The stirring apparatus of claim 14, said last mentioned comprising a lid engaging said flask.

16. The stirring apparatus of claim 15, said tubular means extending through said lid.

17. The stirring apparatus of claim 14, said tubular means having a closed upper end.

18. The stirring apparatus of claim 7, said stirrer means comprising a continuous impeller extending outwardly from the rotational axis thereof.

19. The stirring apparatus of claim 18, said stirrer means comprising a hollow member, and said impeller comprising a bar magnet attached to the bottom of said hollow member.

20. The stirring apparatus of claim 18, said stirrer means comprising a hollow member, a bar magnet within said hollow member, and said impeller comprising a blade attached to the bottom of said hollow member.

21. In apparatus for stirring liquid such as culture medium wherein a flask has a magnetically attractable stirrer wherein buoyant relative to liquid in said flask, means exteriorly of said flask for generating a moving electromagnetic field for rotating said stirrer, and guide means in said flask for guiding said stirrer for rotational movement about a vertical axis and for movement along said axis as said stirrer moves vertically as the liquid level in the flask changes, the improvement wherein the stirrer comprises only continuous impeller means extending outwardly from and extending through the rotational axis of the stirrer for causing movement of liquid in the flask.

22. In apparatus for stirring liquid such as culture medium wherein a flask has a magnetically attractable stirrer therein buoyant relative to liquid in said flask, means exteriorly of said flask for generating a moving electromagnetic field for rotating said stirrer, and guide means in said flask for guiding said stirrer for rotational movement about a vertical axis and for movement along said axis as said stirrer moves vertically as the liquid level in the flask changes, the stirrer comprising only continuous impeller means extending outwardly from the rotational axis of the stirrer for causing movement of liquid in the flask, said guide means extending only above the stirrer and comprising a rod extending upwardly from said stirrer.

23. An apparatus as in claim 22, said guide means further comprising tubular means carried by said flask and receiving said rod therein.

24. An apparatus as in claim 23, and further comprising a lid on said flask, said tubular means carried by said lid.

25. An apparatus as in claim 24, said tubular means extending through said lid.

26. An apparatus as in claim 25, said tubular means comprising a tube having a closed upper end.

27. An apparatus as in claim 26, and means for joining said tube to said lid.

28. An apparatus as in claim 24, said tubular means comprising a tube having a closed upper end.

29. An apparatus as in claim 28, and means for hermetically joining said tube to said lid.

30. An apparatus as in claim 21, said impeller means consisting of a single impeller.

31. An apparatus as in claim 30, said impeller means being a bar magnet.

32. An apparatus as in claim 30, said impeller means being a blade, said buoyant stirrer comprising a hollow member, said blade attached to the bottom of said hollow member.

33. An apparatus as in claim 21, said impeller means consisting of a pair of spaced, parallel impellers.

* * * * *